US005893196A

United States Patent [19]

Tserng

[11] Patent Number: 5,893,196

[45] Date of Patent: Apr. 13, 1999

[54] RETRACTABLE LUGGAGE HANDLE ASSEMBLY

[76] Inventor: Yueh Chy Tserng, No. 26-21, Shi She Juang, Shi She Li, Chang Hua, Taiwan

[ * ] Notice: This patent is subject to a terminal disclaimer.

[21] Appl. No.: 08/886,048

[22] Filed: Jun. 30, 1997

[51] Int. Cl.[6] ..... A47B 95/02

[52] U.S. Cl. ..... 16/115; 190/115; 280/655

[58] Field of Search ..... 16/115; 190/115, 190/39, 18 A, 117; 280/655, 655.1, 47.31, 47.315, 47.371, 37, 47.26; 403/327, 322, 109

[56] References Cited

U.S. PATENT DOCUMENTS

| | | | |
|---|---|---|---|
| 5,367,743 | 11/1994 | Chang | 16/115 |
| 5,499,702 | 3/1996 | Wang | 16/115 |
| 5,515,574 | 5/1996 | Larson | 16/115 |
| 5,653,000 | 8/1997 | Lee | 16/115 |
| 5,694,663 | 12/1997 | Tserng | 16/115 |
| 5,727,898 | 3/1998 | Lu | 16/115 |

*Primary Examiner*—Chuck Y. Mah
*Attorney, Agent, or Firm*—Charles E. Baxley, Esq.

[57] ABSTRACT

A handle includes two pipes slidably engaged in two tubes which are slidably engaged in two ducts. The pipes and the ducts each includes a lower portion having an actuator and a latch. The latches may secure the pipes to the tubes and may secure the tubes to the ducts. The actuators each has a cam for disengaging the latches from the tube and the duct. The pipes and the tubes each includes a flat surface for engaging with that of the actuators and for securing the actuators in place. The pipes and the tubes and the ducts may be secured together when they are folded to the compact folding structure.

2 Claims, 2 Drawing Sheets

RETRACTABLE LUGGAGE HANDLE ASSEMBLY

BACKGROUND OF THE INVENTION

1. Field of the Invention

The present invention relates to a handle, and more particularly to a retractable luggage handle assembly.

2. Description of the Prior Art

U.S. Pat. No. 5,308,103 to Chin-Shung discloses a collapsible luggage trolley that includes a complicated structure. In addition, it is difficult to increase the number of sections or to increase the length of the handle for such a trolley.

The present invention has arisen to provide a novel structure.

SUMMARY OF THE INVENTION

The primary objective of the present invention is to provide a retractable luggage handle assembly which may be easily operated.

In accordance with one aspect of the invention, there is provided a handle assembly comprising a pair of ducts each including an upper opening and a lower puncture, a pair of tubes slidably engaged in the ducts and each including a lower aperture for aligning with the opening and each including an upper orifice, the tubes each including a lower puncture for aligning with the lower puncture of the duct, a pair of pipes slidably engaged in the tubes and each including a lower hole and an upper handle, and a hand grip slidably engaged in the handle. A pair of links are engaged in the pipes and secured to the hand grip. A first actuator is secured to the links and includes a first cam means. A first securing means is engaged in the lower portion of the pipes and includes a first latch means for engaging with the hole and the orifice. The first cam means of the first actuator is engaged with the first latch means for disengaging the first latch means from the orifice when the first actuator is moved toward the handle. The first latch means includes at least one ear for engaging with the first cam means and for allowing the first latch means to be disengaged from the orifice by the first cam means. A second securing means is engaged in the lower portion of the tubes and includes a second latch means for engaging with the opening and the aperture and for securing the ducts to the tubes. The second latch means includes at least one ear. A second actuator includes a second cam means for engaging with the ear of the second latch means. The second cam means is caused to engage with the ear of the second latch means for disengaging the second latch means from the opening when the lower portion of the pipe moves downward to engage with the second actuator. The second cam means is actuated to engage with the ear of the second latch means for disengaging the second latch means from the opening when the second actuator is moved against the biasing means and when the pipe moves downward toward the second cam means. The first latch means is biased to engage with the first puncture and the second puncture of the ducts and the tubes for securing the pipes and the tubes and the ducts together when the pipes are engaged in the tubes and when the tubes are engaged in the ducts.

The lower ends of the pipes and the tubes each includes one or two flat surfaces, and the actuators each includes one or two flat surfaces for engaging with the flat surfaces of the pipes and the tubes and for allowing the actuators to be stably retained in place and for preventing the actuators from rotating relative to the pipes and the tubes and for allowing the actuators to move longitudinally relative to the pipes and the tubes only.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A co-pending US patent application was filed on Aug. 15, 1995, with the Ser. No. 08/515,168, now allowed. The co-pending US patent application is taken as reference for the present invention.

Figure 1:
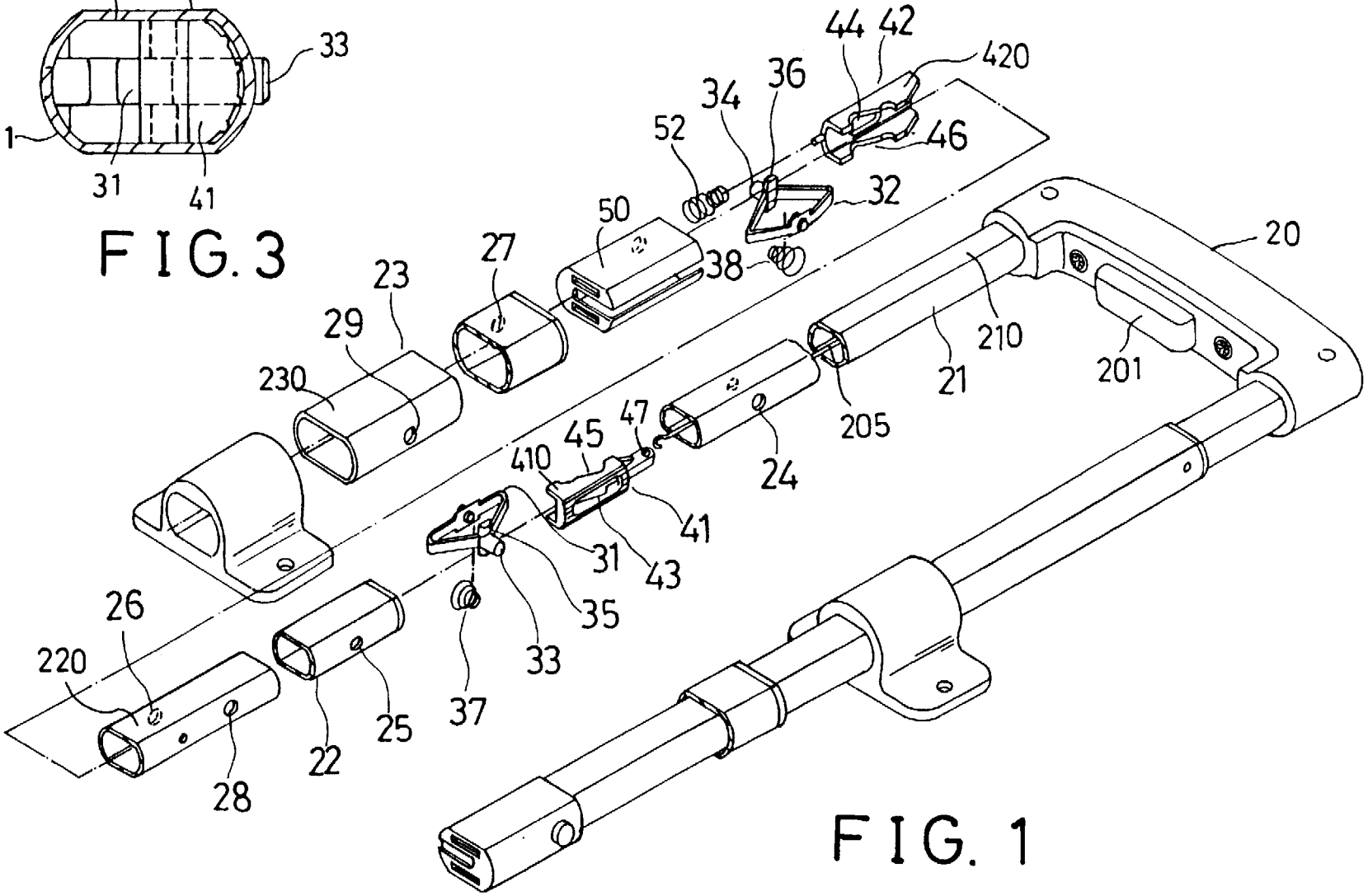
FIG. 1 is an exploded view of a retractable luggage handle assembly in accordance with the present invention.
Figure 2:
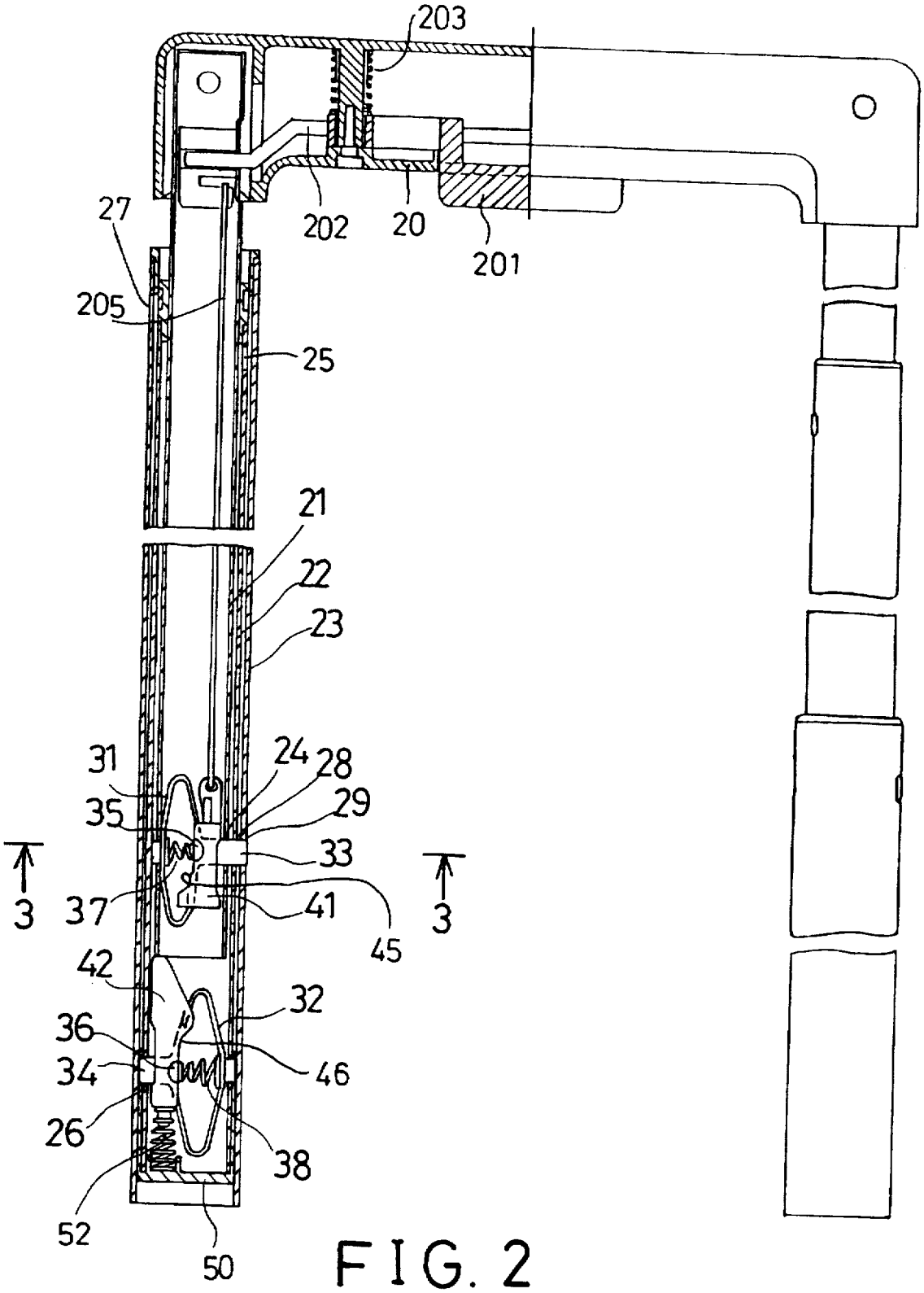
FIG. 2 is a partial cross sectional view of the retractable luggage handle assembly.

Referring to the drawings, and initially to FIGS. 1 and 2, a retractable luggage handle assembly in accordance with the present invention comprises two pipes 21 slidably engaged in two tubes 22 respectively and the tubes 22 are slidably engaged in two ducts 23 respectively. The pipes 21 include a handle 20 secured on top and a hand grip 201 slidably engaged in the handle 20. A beam 202 is secured to the hand grip 201 and moved in concert with the hand grip 201. A spring 203 is biased against the hand grip 201 for biasing the hand grip 201 outward of the handle 20. A pair of links 205 are engaged in the pipes 21 and are secured to the beam 202. The pipes 21 each includes a hole 24 formed in the lower portion. The tubes 22 each includes an orifice 25 formed in the upper portion and an aperture 26 and a puncture 28 formed in the lower portion. The ducts 23 each includes an opening 27 formed in the upper portion and a puncture 29 formed in the lower portion.

A catch means 31 is engaged in the lower portion of the pipe 21 and includes a O-shaped body having a latch 33 for engaging with the hole 24 and the orifice 25 so as to secure the tube 22 and the pipe 21 together. A spring 37 is engaged in the body 31 for biasing the latch 33 to engage with the hole 24 and the orifice 25. The latch 33 includes a pair of laterally extended ears 35. An actuator 41 includes a hole 47 for securing to the link 205 and includes an oblong hole 43 for engaging with the latch 33 and for allowing the latch 33 to slide along said oblong hole 43. The actuator 41 includes a cam surface 45 for engaging with the ears 35 and for disengaging the latch 33 from the tube 22 when the actuator 41 is pulled toward the handle 20 by the link 205 and the hand grip 201. The latch 33 is allowed to engage with the tube 22 when the actuator 41 and the link 205 and the beam 202 are moved downward by the spring 203.

Another catch means 32 is engaged in the lower portion of the tube 22 and includes a O-shaped body having a latch 34 for engaging with the aperture 26 and with the opening 27 so as to secure the tube 22 and the duct 23 together. A spring 38 may bias the latch 34 to engage with the aperture 26 and the opening 27. The latch 34 includes a pair of lateral ears 36. An actuator 42 includes an oblong hole 44 for engaging with the latch 34 and for allowing the latch 34 to slide along said oblong hole 44. The actuator 42 includes a cam surface 46 for engaging with the ears 36 and for disengaging the latch 34 from the tube 22 and for allowing the latch 34 to engage with the duct 23. A cap 50 is secured to the bottom portion of the tube 22 and a spring 52 is engaged between the cap 50 and the actuator 42 for biasing the actuator 42 upward.

Figure 3:
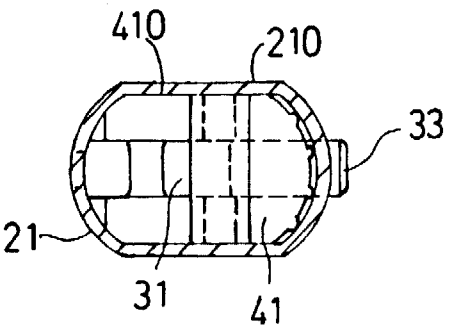
FIG. 3 is a partial cross sectional view taken along lines 3—3 of FIG. 2, illustrating the operation of the retractable luggage handle assembly.

As shown in FIGS. 1 and 3, the pipes 21 and the tubes 22 each includes one or two flat side surfaces 210, 220, 230, particularly formed in the lower end portions, for engaging with the flat side surfaces 410, 420 of the actuators 41, 42 (FIG. 3) and for stably retaining the actuators 41, 42 in place, such that the actuators 41, 42 may be prevented from moving laterally relative to the pipes 21 and the tubes 22 and may be stably guided to move longitudinally relative to the pipes 21 and the tubes 22.

In operation, as shown in FIG. 2, when the actuator 41 is not pulled upward by the hand grip 201, the latch 33 is allowed to engage with the hole 24 and with the orifice 25 so as to secure the tube 22 and the pipe 21 together such that the pipes 21 may not be moved inward of the tubes 22. However, when the actuator 41 is pulled upward by the hand grip 201, the latch 33 is disengaged from the tube 22 by the cam surface 45 such that the pipes 21 may be moved relative to the tubes 22. When the hand grip 201 is released and when the actuator 41 and the link 205 and the beam 202 are moved downward by the spring 203, the cam surface 45 of the actuator 41 allows the latch 33 to engage with the tube 22 again.

The actuator 42 is normally biased upward by the spring 52 so as to allow the latch 34 to engage with the aperture 26 and with the opening 27 and so as to secure the tube 22 and the duct 23 together such that the tubes 22 may not be moved inward of the ducts 23. However, when the actuator 42 is moved downward against the spring 52 by the tubes 21, the latch 34 is disengaged from the duct 23 by the cam surface 46 such that the tubes 22 may be moved relative to the ducts 23. When the tubes 21 are disengaged from the actuators 42 and when the actuator 42 is moved upward again by the spring 52, the cam surface 46 of the actuator 42 allows the latch 34 to engage with the duct 23 again.

As shown in FIG. 2, the actuators 41, 42 and the catch means 31, 32 are arranged opposite to each other. For example, as shown in FIG. 2, the actuator 41 is disposed in the right side and the actuator 42 is disposed in the left side. The aperture 26 and the opening 27 are arranged opposite to the hole 24 and the orifice 25 for engaging with the latch 34. The punctures 28, 29 are provided for engaging with the latch 33 when the pipes 21 are engaged in the tubes 22 and when the tubes 22 are engaged in the ducts 23, such that the pipes 21 and the tubes 22 and the ducts 23 may be stably retained in place when the handle assembly is retracted to the compact folding configuration.

Accordingly, the retractable luggage handle assembly in accordance with the present invention includes the securing means 31, 32 that may be easily operated when the hand grip 201 is operated. The handle assembly may be retained in place when the whole handle assembly is folded to the compact folding structure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A handle assembly comprising:

a pair of ducts each including an upper portion having an opening and each including a lower portion having a first puncture arranged opposite to said opening, a pair of tubes slidably engaged in said ducts respectively, said tubes each including a lower portion having an aperture for aligning with said opening and each including an upper portion having an orifice arranged opposite to said aperture, said lower portions of said tubes each including a second puncture for aligning with said first puncture of said duct, a pair of pipes slidably engaged in said tubes, said pipes each including a lower portion having a hole and each including an upper portion both connected to a handle, a hand grip slidably engaged in said handle, means for biasing said hand grip outward of said handle, link means engaged in said pipes and secured to said hand grip and moved in concert with said hand grip, a first actuator secured to said link means and moved in concert with said link means, said first actuator including a first cam means, a first securing means engaged in said lower portion of said pipes and including a first latch means for engaging with said hole and said orifice and for securing said pipe to said tube and for preventing said pipe from moving relative to said tube, and means for biasing said first latch means to engage with said hole and said orifice, said first cam means of said first actuator being engaged with said first latch means for disengaging said first latch means from said orifice when said first actuator is moved toward said handle by said hand grip, said first latch means including at least one ear for engaging with said first cam means and for allowing said first latch means to be disengaged from said orifice by said first cam means, a second securing means engaged in said lower portion of said tubes and including a second latch means for engaging with said opening and said aperture and for securing said ducts to said tubes, said second latch means including at least one ear, means for biasing said second latch means to engage with said opening, a second actuator including a second cam means for engaging with said at least one ear of said second latch means, said second cam means being caused to engage with said at least one ear of said second latch means for disengaging said second latch means from said opening when said lower portion of said pipe moves downward to engage with said second actuator, and means for biasing said second actuator toward said pipes and for engaging said second latch means with said opening, said second cam means being actuated to engage with said at least one ear of said second latch means for disengaging said second latch means from said opening when said second actuator is moved against said biasing means and when said pipe moves downward toward said second cam means, and said first latch means being biased to engage with said first puncture and said second puncture of said ducts and said tubes for securing said pipes and said tubes and said ducts together when said pipes are engaged in said tubes and when said tubes are engaged in said ducts.

2. A handle assembly comprising:

a pair of ducts each including an upper portion having an opening, a pair of tubes slidably engaged in said ducts respectively, said tubes each including a lower portion having an aperture and an upper portion having an orifice, said lower portions of said tubes each including at least one first flat surface, a pair of pipes slidably engaged in said tubes, said pipes each including a lower portion having a hole and each including an upper portion both connected to a handle, said lower portions of said pipes each including at least one second flat surface, a hand grip slidably engaged in said handle, means for biasing said hand grip outward of said handle, link means engaged in said pipes and secured to said hand grip and moved in concert with said hand grip, a first actuator secured to said link means and moved in concert with said link means, said first actuator including a first cam means and including at least one third flat surface for engaging with said at least one second flat surface of said pipe and for stably retaining said first actuator in place, a first securing means engaged in said lower portion of said pipes and including a first latch means for engaging with said hole and said orifice and for securing said pipe to said tube and for preventing said pipe from moving relative to said tube, and means for biasing said first latch means to engage with said hole and said orifice, said first cam means of said first actuator being engaged with said first latch means for disengaging said first latch means from said orifice when said first actuator is moved toward said handle by said hand grip, said first latch means including at least one ear for engaging with said first cam means and for allowing said first latch means to be disengaged from said orifice by said first cam means, a second securing means engaged in said lower portion of said tubes and including a second latch means for engaging with said opening and said aperture and for securing said ducts to said tubes, said second latch means including at least one ear, means for biasing said second latch means to engage with said opening, a second actuator including a second cam means for engaging with said at least one ear of said second latch means, said second cam means being caused to engage with said at least one ear of said second latch means for disengaging said second latch means from said opening when said lower portion of said pipe moves downward to engage with said second actuator, said second actuator including at least one fourth flat surface for engaging with said at least one first flat surface of said tube and for stably retaining said second actuator in place, and means for biasing said second actuator toward said pipes and for engaging said second latch means with said opening, said second cam means being actuated to engage with said at least one ear of said second latch means for disengaging said second latch means from said opening when said second actuator is moved against said biasing means and when said pipe moves downward toward said second cam means.

* * * * *